US009449557B2

(12) United States Patent
Kim

(10) Patent No.: US 9,449,557 B2
(45) Date of Patent: Sep. 20, 2016

(54) ORGANIC LIGHT EMITTING DISPLAY DEVICE AND DRIVING METHOD THEREOF

(71) Applicant: LG Display Co., Ltd., Seoul (KR)

(72) Inventor: Seung Tae Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/978,991

(22) Filed: Dec. 22, 2015

(65) Prior Publication Data

US 2016/0111046 A1 Apr. 21, 2016

Related U.S. Application Data

(62) Division of application No. 13/629,120, filed on Sep. 27, 2012, now Pat. No. 9,275,583.

(30) Foreign Application Priority Data

Oct. 4, 2011 (KR) ..... 10-2011-0100871

(51) Int. Cl.
*G09G 3/32* (2016.01)

(52) U.S. Cl.
CPC ..... *G09G 3/3258* (2013.01); *G09G 3/3275* (2013.01); *G09G 2300/04* (2013.01); *G09G 2310/027* (2013.01); *G09G 2310/0248* (2013.01); *G09G 2310/08* (2013.01); *G09G 2330/021* (2013.01)

(58) Field of Classification Search
CPC ..... G09G 2310/0248–2310/0251
USPC ..... 345/204, 690
See application file for complete search history.

(56) References Cited

U.S. PATENT DOCUMENTS

| | | | | |
|---|---|---|---|---|
| 2003/0161189 | A1* | 8/2003 | Park | G09G 3/3648 365/189.07 |
| 2005/0093769 | A1* | 5/2005 | Ushigusa | G09G 3/3216 345/3.2 |
| 2007/0013623 | A1* | 1/2007 | Kimura | G09G 3/3216 345/84 |
| 2008/0284771 | A1* | 11/2008 | Matsuki | G09G 3/3692 345/211 |
| 2009/0207118 | A1* | 8/2009 | Lee | G09G 3/3688 345/98 |

FOREIGN PATENT DOCUMENTS

| | | |
|---|---|---|
| CN | 1609936 | 4/2005 |
| CN | 1897091 | 1/2007 |

OTHER PUBLICATIONS

Office Action issued in Chinese Patent Application No. 201210377042.8, mailed Jul. 2, 2014, 12 pages.

* cited by examiner

*Primary Examiner* — Carolyn R Edwards
(74) *Attorney, Agent, or Firm* — Brinks Gilson & Lione

(57) ABSTRACT

Disclosed is an organic light emitting display device including: plurality of data lines; a charging line formed in a direction crossing the plurality of data lines; and charging switches connected between the charging line and the data lines. The charging line inputs a charging voltage and the charging switches are individually controlled in data line.

12 Claims, 10 Drawing Sheets

ORGANIC LIGHT EMITTING DISPLAY DEVICE AND DRIVING METHOD THEREOF

The present patent document is a divisional of U.S. patent application Ser. No. 13/629,120, filed on Sep. 27, 2012, which claims priority under 35 U.S.C. §119(a) of Korean Patent Application No. 10-2011-0100871 filed on Oct. 4, 2011, which is hereby incorporated by reference in its entirety.

BACKGROUND

1. Field of the Invention

Embodiments relate to an organic light-emitting display device. Also, embodiments relate to a method of driving an organic light-emitting display device.

2. Discussion of the Related Art

Devices for displaying information are being widely developed. The display devices include liquid crystal display (LCD) devices, organic light-emitting display (OLED) devices, electrophoresis display devices, field emission display (FED) devices, and plasma display devices.

Among these display devices, OLED devices have the features of lower power consumption, wider viewing angle, lighter weight and higher brightness compared to LCD devices. As such, the OLED device is considered to be next generation display devices.

FIG. 1 is a block diagram showing an OLED device according to the related art.

Referring to FIG. 1, the OLED device of the related art includes an organic light emission panel 101, a gate driver 110, a data driver 120 and a timing controller 130.

A plurality of gate lines GL1~GLn are formed on the organic light emission panel 101. Also, a plurality of data lines DL1~DLm extending in a direction crossing the gate lines GL1~GLn are formed on the organic light emission panel 101.

The plurality of gate lines GL1~GLn are electrically connected to the gate driver 110. The plurality of data lines DL1~DLm are electrically connected to the data driver 120.

The gate driver 110 uses signals applied from the timing controller 130 and applies a gate voltage to the organic light emission panel 101 through the gate line GL.

The data driver 120 uses signals applied from the timing controller 130 and applies data voltages to the organic light emission panel 101 through the data lines DL.

The heat generation caused by driving the related art OLED device becomes a big issue. More particularly, the heat generation in the data driver, which is being fabricated in an integrated circuit chip shape, becomes a large problem. In order to solve the heat generation of the data driver and enhance a data charging property, a charge-sharing method allowing adjacent pixels to share electric charges with each other and a pre-charging method enabling an externally fixed voltage to be input prior to the data voltage are proposed. The charge-sharing and the pre-charging are being used alone or together.

FIG. 2 is a circuit diagram showing the connection configuration of a data driver according to the related art.

As shown in FIG. 2, the related art data driver includes a data latch 151 and a plurality of DACs (Digital-to-Analog Converters) 153.

The data latch 151 sequentially latches data signals applied from the timing controller. Also, the data latch 151 simultaneously outputs the latched data signals for a single horizontal line in response to a source output enable signal from the timing controller.

The plurality of DACs 153 converts a single horizontal line of data signal applied from the data latch 151 into analog data voltages. The analog data voltages are transmitted from the DACs 153 to the plurality of data lines DL.

The data lines DL are used to transfer the data voltages to the organic light emission panel. Each data line DL is electrically connected to the respective DAC 153 through a switch 155. The switch 155 replies to an output enable signal OE and transfers the data voltage from the respective DAC 153 to the respective data line on the organic light emission panel.

The data driver further includes a charging line 161 extending in a direction crossing the data lines DL. A charging voltage Vpre is applied to one end of the charging line 161. A charging capacitor 163 connected to the charging line 161 has a function of charging electric charges for a pre-charging and a charge sharing. The charging line 161 is electrically connected to the data lines DL through a plurality of charging switches 157. The plurality of charging switches 158 are controlled by a charging control signal Pre applied from the timing controller. The charging control signal Pre and the output enable signal OE are opposite to each other in waveform. When the charging control signal Pre has a high level, the pre-charging and the charge-sharing are performed for the data lines DL. On the contrary, if the output enable signal OE has a high level, the data voltages are applied from the DACs 153 to the data lines DL.

FIG. 3 is a waveform diagram illustrating the voltage variation of a data line in accordance with a charging control signal and an output enable signal of the related art.

DL(a) of FIG. 3 shows voltage state on the data line DL when the pre-charging and the charge-sharing are not performed. DL(b) shows voltage state on the data line DL when the pre-charging and the charge-sharing are performed.

The charging control signal Pre has the high level in a fixed interval whenever a fixed period elapsed. The output enable signal OE has the low level when the charging control signal Pre maintains the high level. Also, the output enable signal OE maintains the high level during the low level interval of the charging control signal Pre.

The data voltage transitions from a high voltage to a low voltage on the basis of the charging voltage Vpre when a first period is exchanged with a second period. At this time, the charge-sharing is performed in response to the charging control signal Pre during the fixed interval, so that power is recovered. When a third period is exchanged with a fourth period, the data voltage rises from the low voltage to high voltage on the basis of the charging voltage Vpre and the pre-charging is performed in response to the charging control signal Pre during the fixed interval. As such, power consumption is reduced.

It is unnecessary to perform the pre-charging and the charge-sharing when a second or fourth period is exchanged with a third or fifth period. Nevertheless, the charging control signal Pre forces the pre-charging or the charge-sharing to be performed. Due to this, power consumption increases. Moreover, the unnecessarily performed pre-charging or charge-sharing causes the data driver to generate large amounts of heat.

BRIEF SUMMARY

According to one general aspect of the present embodiment, an organic light-emitting display device includes: a plurality of data lines; a charging line formed in a direction crossing the plurality of data lines; and charging switches connected between the charging line and the data lines, wherein the charging line inputs a charging voltage and the charging switches are individually controlled in data line.

A driving method of an organic light-emitting display device according to another general aspect of the present embodiment includes: detecting the polarity of a data signal by comparing the data signal with a reference data; temporarily storing the detected polarity of the data signal; determining whether or not to perform a pre-charging and a charge-sharing through a comparison of the detected polarity and the stored polarity; and performing the pre-charging and the charge-sharing in data line on the basis of the determined resultant.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION OF THE DRAWINGS AND THE PRESENTLY PREFERRED EMBODIMENTS

Figure 1:
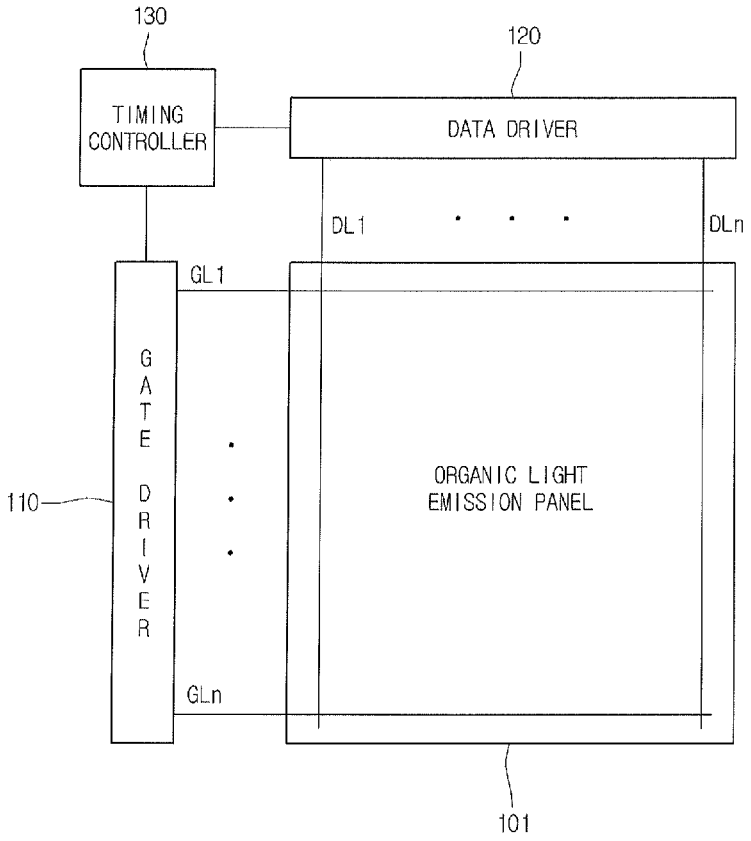
FIG. 1 is a block diagram showing an OLED device according to the related art.
Figure 2:
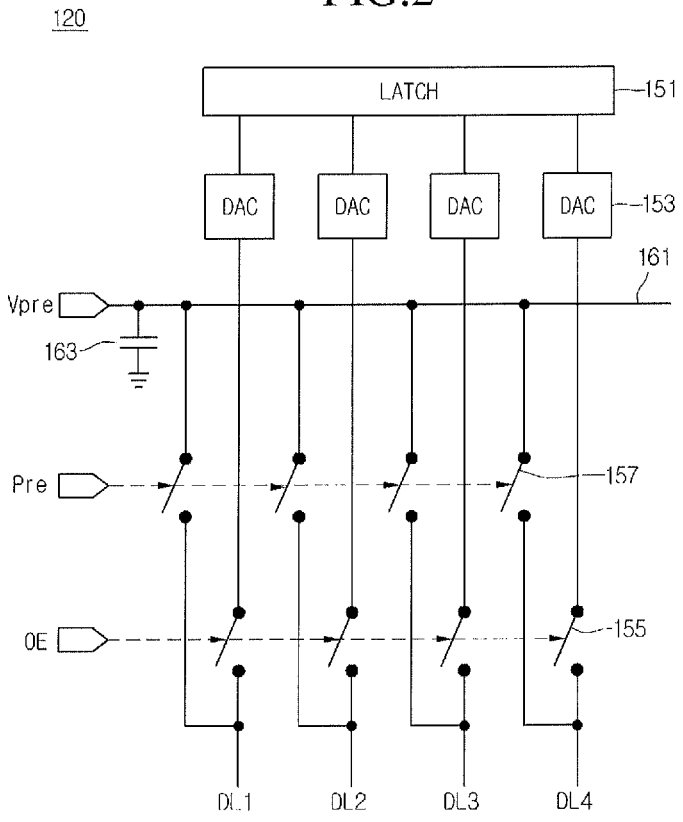
FIG. 2 is a circuit diagram showing the connection configuration of a data driver according to the related art.
Figure 3:
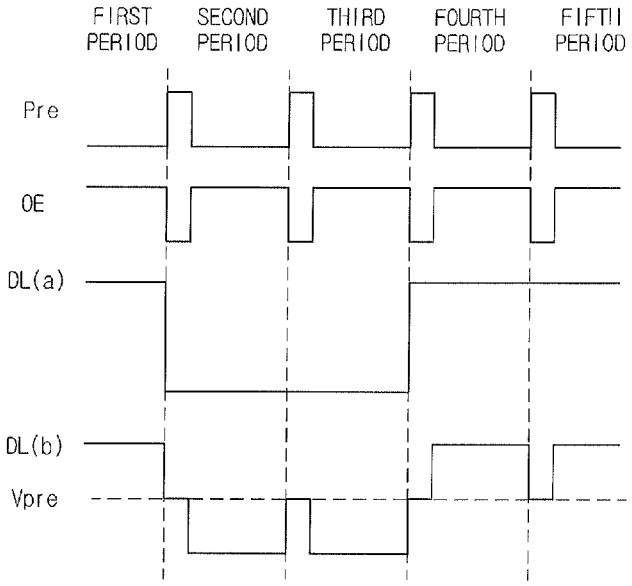
FIG. 3 is a waveform diagram illustrating voltage of a data line being varied along a charging control signal and an output enable signal of the related art.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 4:
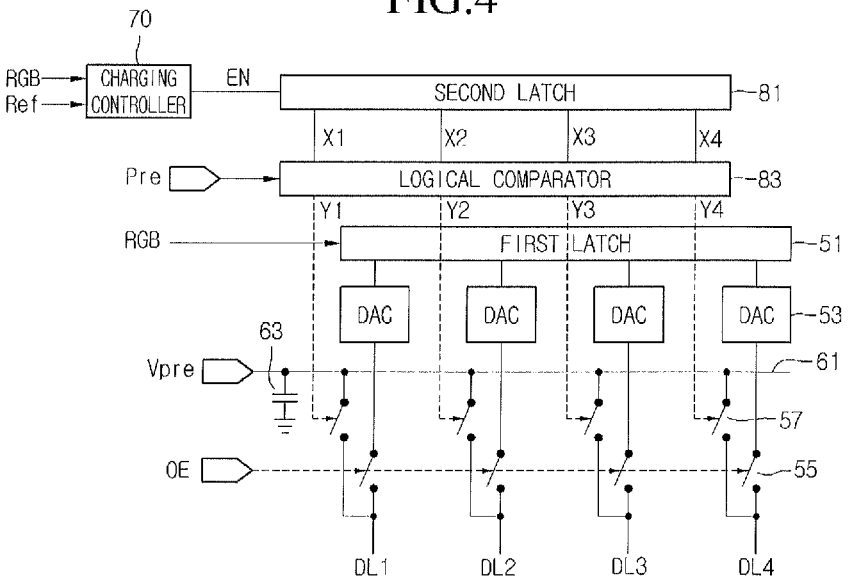
FIG. 4 is a circuit diagram showing a data driver of an OLED device according to a first embodiment of the present disclosure.

FIG. 4 is a circuit diagram showing a data driver of an OLED device according to a first embodiment of the present disclosure.

Referring to FIG. 4, the data driver of the OLED device according to a first embodiment of the present disclosure includes a first latch 51 and a plurality of DACs 53 connected to the first latch 51.

The first latch 51 sequentially latches data signals RGB applied from the timing controller (not shown). Also, the first latch 51 simultaneously outputs the latched data signals for a single horizontal line in response to a source output enable signal from the timing controller.

The plurality of DACs 53 convert a single horizontal line of data signals applied from the first latch 51 into analog data voltages. The analog data voltages are simultaneously output from the DACs 53 to the plurality of data lines DL. The data voltages output from the plurality of DACs 53 can be applied to the plurality of data lines in response to an output enable signal OE from the timing controller (not shown). To this end, the data driver includes switches 55 each connected to the plurality of data lines DL. The switch 55 can be controlled by the output enable signal OE applied from the timing controller. The switch 55 can be a thin film transistor. When the thin film transistors are used as switches 55, the output enable signal is applied to a gate electrode of each thin film transistor, source and drain electrodes of each thin film transistor are connected to the respective DAC 53 and the respective data line DL.

The data driver can further include a charging line 61 extending in a direction crossing the data lines DL. A charging voltage Vpre can be applied to one end of the charging line 61. A charging capacitor 63 can be connected to the charging line 61. When the data voltage falls from a high voltage to a low voltage on the basis of the charging voltage Vpre, the charging capacitor 63 can charge electric charges which are discharged from the data lines due to a falling voltage. On the contrary, if the data voltage rises from the low voltage to the high voltage on the basis of the charging voltage Vpre, the charging capacitor 63 discharges electric charges toward the data lines DL due to a rising voltage. In other words, at the pre-charging and the charge-sharing, electric charges can be charged and discharged by the charging capacitor 63. Therefore, power consumption can be reduced by an amount of electric charge being charged and discharged.

The charging line 61 can be connected to the plurality of data lines DL through a plurality of charging switches 57. The plurality of charging switches 57 can be individually controlled by respective logical signals Y1~Y4. For example, the charging switch 57 connected to the first data line DL1 is controlled by a first logical signal Y1, the charging switch 57 connected to the second data line DL2 is controlled by a second logical signal Y2, the charging switch 57 connected to the third data line DL3 is controlled by a third logical signal Y3, and the charging switch 57 connected to the fourth data line DL4 is controlled by a fourth logical signal Y4.

The charging switch 57 can be configured with a thin film transistor. If the thin film transistors are used as charging switches 57, the logical signals Y1~Y4 are applied to gate electrodes of the respective thin film transistors, source electrodes of the thin film transistors are commonly connected to the charging line 61, and drain electrodes of the thin film transistors are connected to the respective data lines DL.

The switches 55 and the charging switches 57 are not limited to those shown in the drawings. In other words, the switches 55 and the charging switches 57 can be included in the data driver by the number of data lines, respectively.

The plurality of logical signals Y1~Y4 can be generated by a charging controller 70, a second latch 81 and a logical comparator 83.

The charging controller 70 can receive a reference data Ref and the data signals and sequentially output enable signals EN. The charging controller 70 compares the data signal RGB with the reference data Ref and determines whether or not it is necessary to perform a pre-charging and a charge-sharing. The charging controller 70 generates the enable signal EN in accordance with the determined resultant and applies the enable signal EN to the second latch 81. Such a charging controller 70 will be explained in detail referring to FIGS. 5 and 6, later.

The second latch 81 can sequentially latch the enable signals EN applied from the charging controller 70 and simultaneously output a single horizontal line of latch signals X1~X4.

The latch signals X1~X4 being output from the second latch 81 are applied to the logical comparator 83. In addition, a charging control signal Pre can be applied to the logical comparator 83. The charging control signal Pre can be generated in the timing controller. If the charging control signal Pre has a high level, the logical comparator 83 outputs the logical signals Y1~Y4. On the contrary, while the charging control signal Pre maintains a low level, the logical comparator 83 does not output the logical signals Y1~Y4. Then, the charging switches 57 are individually opened and closed by the respective logical signals Y1~Y4. As such, the pre-charging and the charge-sharing can be controlled by the charging control signal Pre.

Figure 5:
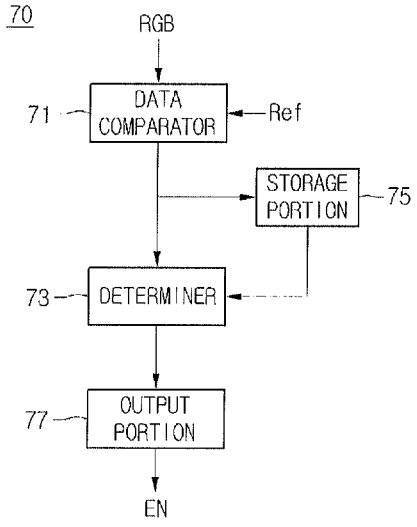
FIG. 5 is a block diagram showing a charging controller of the OLED device according to a first embodiment of the present disclosure.

FIG. 5 is a block diagram showing a charging controller of the OLED device according to a first embodiment of the present disclosure.

Referring to FIG. 5, the charging controller 70 of the OLED device includes a data comparator 71, a determiner 73, a storage portion 75 and an output portion 77.

The data comparator 71 can input serial data signals RGB and a reference data Ref. The data signal RGB and the reference data Ref can be applied from the timing controller (not shown) to the data comparator 71. The reference data Ref can have a value input in the data driver. The data comparator 71 can output a polarity signal by comparing the data signal RGB with the reference data Ref.

Figure 6:
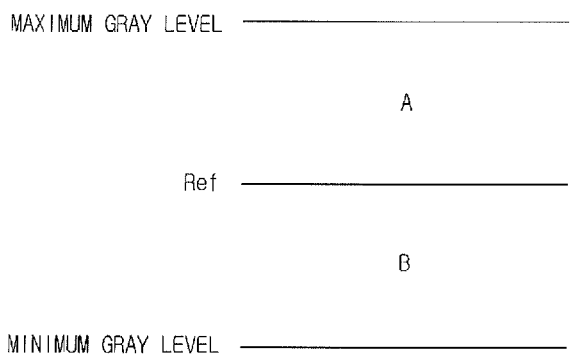
FIG. 6 is a data sheet illustrating polarities, which are determined through the comparison of a data signal with a reference data according to a first embodiment of the disclosure.

FIG. 6 is a data sheet illustrating polarities being determined through the comparison of a data signal RGB and a reference data Ref according to a first embodiment of the disclosure.

As shown in FIG. 6, the data signal RGB can have any one from a minimum gray level to a maximum gray level.

The data signal RGB can be defined on the basis of the reference data Ref into an A polarity between the reference data Ref and the maximum gray level and a B polarity between the reference data Ref and minimum gray level. The reference data Ref can be set to be any one between the maximum and minimum gray levels. In other words, the reference data Ref is a data signal corresponding to the charging voltage Vpre.

The data signal RGB and the reference data can be 8-bit binary codes. When the data signal RGB is compared to the reference data Ref, the entire bits within the 8-bit binary code may be used in the comparison in order to determine the polarity of the data signal.

The comparison of the data signal RGB and the reference data Ref can be performed for only some most significant bits, in order to enhance the response speed of the data comparator 71. If a single most significant bit is used in the comparison, the accuracy of polarity determination is about 50%. When two most significant bits are used in the comparison, the accuracy of polarity determination corresponds to 75% in which the accuracy of 25% is increased by the second bit. In case three most significant bits are used in the comparison, the accuracy of polarity determination is 87.5% in which the accuracy of 12.5% is further increased by the third bit. When four most significant bits are used in the comparison, the accuracy of polarity determination corresponds to 93.75% in which the accuracy of 6.25% is still further increased by the fourth bit. The ordinary power supply units have a tolerance of ±5%. As such, in order to accurately determine the polarity of a data signal, the comparison of the data signal RGB with the reference data Ref must be performed for at least four most significant bits.

The data comparator 71 determines the polarity of the data signal RGB and applies the determined polarity of the data signal to the determiner 73 and the storage portion 75.

The storage portion 75 temporarily stores the polarities of the data signals of a previous period. In other words, the storage portion 75 temporarily stores the polarities of the data signals during a single period and then applies the polarities of the data signals of the previous period (hereinafter, the polarities of the previous data signal) to the determiner 73.

The determiner 73 compares the polarity of the previous data signal applied from the storage portion 75 with the polarity of the current data signal applied from the data comparator 71 and determines whether or not it is necessary to perform the pre-charging and the charge-sharing. For example, if the polarity of the previous data signal is the same as that of the current data signal, the determiner 73 determines that it is unnecessary to perform the pre-charging and the charge-sharing. On the contrary, when the polarity of the previous data signal is different from that of the current data signal, the determiner 73 determines that it is necessary to perform the pre-charging and the charge-sharing. The determiner 73 supplies the output portion 77 with the determination signal about whether or not to perform the pre-charging and the charge-sharing.

The output portion 77 generates an enable signal EN, which is used to control the pre-charging and the charge-sharing, on the basis of the determination signal applied from the determiner 73. The enable signal EN with a high level enables the pre-charging and the charge-sharing to be performed. Meanwhile, the enable signal EN with a low level forces the pre-charging and the charge-sharing to be not performed.

Figure 7:
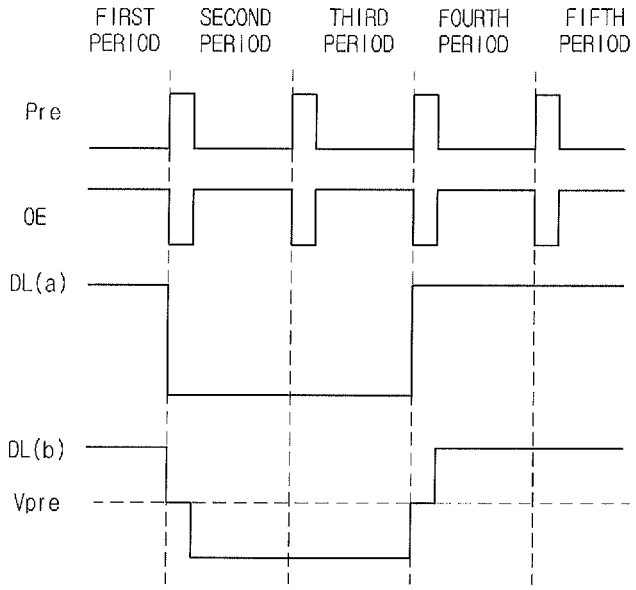
FIG. 7 is a waveform diagram illustrating voltage variation on a data line of the OLED device according to a first embodiment of the present disclosure.

FIG. 7 is a waveform diagram illustrating voltage variation on a data line of the OLED device according to a first embodiment of the present disclosure.

Referring to FIGS. 4 through 7, DL(a) of FIG. 7 shows voltage state on a data line DL when the pre-charging and the charge-sharing are not performed. DL(b) shows voltage state on the data line DL when the pre-charging and the charge-sharing are performed. The charging voltage Vpre is a analog signal corresponding to the reference data Ref.

The charging control signal Pre has the high level in a fixed interval whenever a fixed period elapsed. The output enable signal OE has the low level when the charging control signal Pre maintains the high level. Also, the output enable signal OE maintains the high level during the low level interval of the charging control signal Pre.

The data voltages of first, fourth and fifth periods have a higher voltage compared to the charging voltage Vpre. The data signals opposite to the data voltage of the first, fourth and fifth periods also have gray levels higher than the reference data Ref. As such, all the data signals of the first, fourth and fifth periods have the A polarity. Meanwhile, the data voltages of second and third periods have a lower voltage compared to the charging voltage Vpre. Also, the data signals opposite to the data voltage of the second and third periods have gray levels lower than the reference data Ref. As such, all the data signals of the second and fourth periods have the B polarity. In accordance therewith, the polarity of the data voltage changes when the first period is exchanged with the second period and the third period is exchanged with the fourth period. As a result, the enable signal EN has a high level in the second and fourth periods.

For example, if an enable signal EN opposite to the first data line DL1 has the high level in the second period, the first latch signal X1 with the high level is output from the second latch 81. As such, the logical comparator 83 outputs the first logical signal Y1 with the high level during the high level interval of the charging control signal Pre. Then, the charging switch 57 connected to the first data line DL1 is closed and the charge-sharing, which allows electric charges to be charged from the first data line DL1 into the charging capacitor 63, is performed. The charge-sharing can enables power to recovery.

Also, when the enable signal EN opposite to the first data line DL1 has the high level in the fourth period, the first latch signal X1 with the high level is output from the second latch 81. As such, the logical comparator 83 outputs the first logical signal Y1 with the high level during the high level interval of the charging control signal Pre. Then, the charging switch 57 connected to the first data line DL1 is closed and the pre-charging, which allows electric charges stored in the charging capacitor 63 to be discharged to the first data line DL1, is performed. The pre-charging can reduce power consumption.

The OLED device according to the first embodiment can control the pre-charging and the charge-sharing to be performed in data line. As such, power consumption can be reduced.

Also, the OLED device according to the first embodiment enables the pre-charging and the charge-sharing to be performed only when the data voltage is steeply varied. Therefore, power consumption can be further reduced. Moreover, the pre-charging and the charge-sharing can be performed only periods when they are needed. As such, heat generation in the data driver can be reduced.

Figure 8:
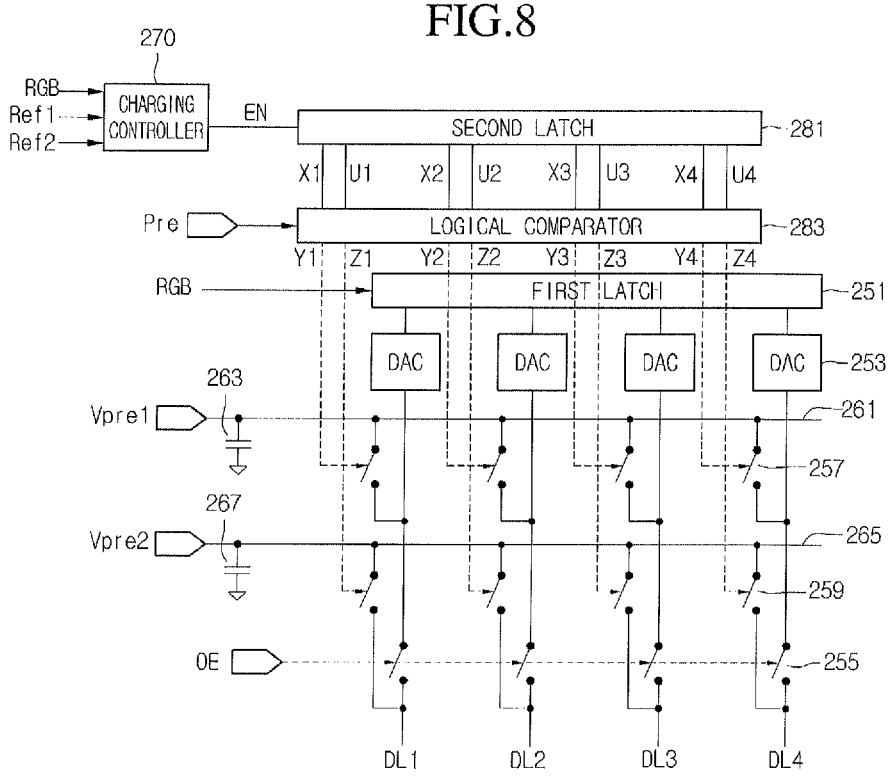
FIG. 8 is a circuit diagram showing a data driver of an OLED device according to a second embodiment of the present disclosure.

FIG. 8 is a circuit diagram showing a data driver of an OLED device according to a second embodiment of the present disclosure.

The second embodiment is the same as the first embodiment except that the polarity of the data signal is distinguished into three steps and the pre-charging and the charge-sharing are performed using first and second charging control signals and primary and secondary charging switches. Accordingly, the description of the first embodiment to be repeated in the second embodiment of the present disclosure will be omitted.

Referring to FIG. 8, the data driver of the OLED device according to a second embodiment of the present disclosure includes a first latch 251 and a plurality of DACs 253 connected to the first latch 251.

The first latch 251 sequentially latches data signals RGB applied from the timing controller (not shown). Also, the first latch 251 simultaneously outputs the latched data signals for a single horizontal line in response to a source output enable signal from the timing controller. The plurality of DACs 253 convert a single horizontal line of data signals applied from the first latch 251 into analog data voltages. The analog data voltages are simultaneously output from the DACs 253 to the plurality of data lines DL The data driver can further include first and second charging lines 261 and 265 extending in a direction crossing the data lines DL. The first and second charging lines 261 and 263 can be formed parallel to each other.

A first charging voltage Vpre1 can be applied to one end of the first charging line 261. A first charging capacitor 263 can be connected to the charging line 261. When the data voltage falls from a high voltage to a low voltage on the basis of the first charging voltage Vpre1, the first charging capacitor 263 can charge electric charges which are discharged from the data lines DL due to a falling voltage. On the contrary, if the data voltage rises from the low voltage to the high voltage on the basis of the first charging voltage Vpre1, the first charging capacitor 263 discharges electric charges toward the data lines DL due to a rising voltage. In other words, at the pre-charging and the charge-sharing, electric charges can be charged and discharged by the first charging capacitor 263. Therefore, power consumption can be reduced by an amount of electric charge being charged and discharged.

A second charging voltage Vpre2 can be applied to one end of the second charging line 265. A second charging capacitor 267 can be connected to the second charging line 265. When the data voltage falls from a high voltage to a low voltage on the basis of the second charging voltage Vpre2, the second charging capacitor 267 can charge electric charges which are discharged from the data lines DL due to a falling voltage. On the contrary, if the data voltage rises from the low voltage to the high voltage on the basis of the second charging voltage Vpre2, the second charging capacitor 267 discharges electric charges toward the data lines DL due to a rising voltage. In other words, at the pre-charging and the charge-sharing, electric charges can be charged and discharged by the second charging capacitor 267. Therefore, power consumption can be further reduced by an amount of electric charge being charged and discharged.

The first charging line 261 can be connected to the plurality of data lines DL through a plurality of primary charging switches 257. The plurality of primary charging switches 257 can be individually controlled by respective primary logical signals Y1~Y4.

The second charging line 265 can be connected to the plurality of data lines DL through a plurality of secondary charging switches 259. The plurality of secondary charging switches 259 can be individually controlled by respective secondary logical signals Z1~Z4.

The primary charging switches 257 and the secondary charging switches 259 can be configured to each include a thin film transistor.

If the thin film transistors are used as primary charging switches 257, the primary logical signals Y1~.Y4 are applied to gate electrodes of the respective thin film transistors, source electrodes of the thin film transistors are commonly connected to the first charging line 261, and drain electrodes of the thin film transistors are connected to the respective data lines DL.

When the thin film transistors are used as secondary charging switches 259, the secondary logical signals Z1~Z4 are applied to gate electrodes of the respective thin film transistors, source electrodes of the thin film transistors are commonly connected to the second charging line 265, and drain electrodes of the thin film transistors are connected to the respective data lines DL.

The switches 255, the primary charging switches 257 and the secondary charging switches 259 are not limited to those shown in the drawings. In other words, the switches 255, the primary charging switches 257 and the secondary charging switches 259 can be included in the data driver by the number of data lines, respectively.

The plurality of primary logical signals Y1~Y4 and the plurality of secondary logical signals Z1~Z4 can be generated by a charging controller 270, a second latch 281 and a logical comparator 283.

The charging controller 270 can receive a first reference data Ref1, a second reference data Ref2 and the data signals and sequentially output enable signals EN. The charging controller 270 compares the data signal RGB with the first reference data Ref1 and the second reference data Ref2, and determines whether or not it is necessary to perform a pre-charging and a charge-sharing. The charging controller 270 generates the enable signal EN in accordance with the determined resultant and applies the enable signal EN to the second latch 281. Such a charging controller 270 will be explained in detail referring to FIGS. 9 and 10, later.

The second latch 281 can sequentially latch the enable signals EN applied from the charging controller 270 and simultaneously output a single horizontal line of primary latch signals X1~'X4 and a single horizontal line of second latch signals U1~U4.

The primary latch signals X1~X4 and the secondary latch signals U1~U4 being output from the second latch 281 are applied to the logical comparator 283. In addition, a charging control signal Pre can be applied to the logical comparator 283. If the charging control signal Pre has a high level, the logical comparator 283 outputs the primary logical signals Y1~Y4 and the secondary logical signals. On the contrary, while the charging control signal Pre maintains a low level, the logical comparator 283 does not output the primary logical signals Y1~Y4 and the secondary logical signals Z1~Z4.

Then, the primary charging switches 257 are individually opened and closed by the respective primary logical signals Y1~Y4. Also, the secondary charging switches 259 are individually opened and closed by the respective secondary logical signals Z1~Z4. As such, the pre-charging and the charge-sharing can be controlled by the charging control signal Pre.

Figure 9:
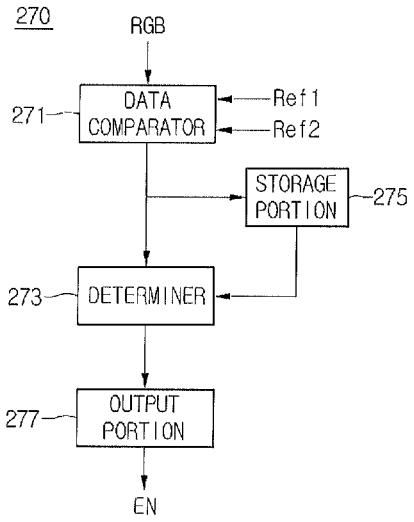
FIG. 9 is a block diagram showing a charging controller of the OLED device according to a second embodiment of the present disclosure.

FIG. 9 is a block diagram showing a charging controller of the OLED device according to a second embodiment of the present disclosure.

Referring to FIG. 9, the charging controller 270 of the OLED device according to the first embodiment includes a data comparator 271, a determiner 273, a storage portion 275 and an output portion 277.

The data comparator 271 can input serial data signals RGB, a first reference data Ref1 and a second reference data Ref2. The data comparator 271 can output a polarity signal by comparing the data signal RGB with the first reference data Ref1 and the second reference data Ref2.

Figure 10:
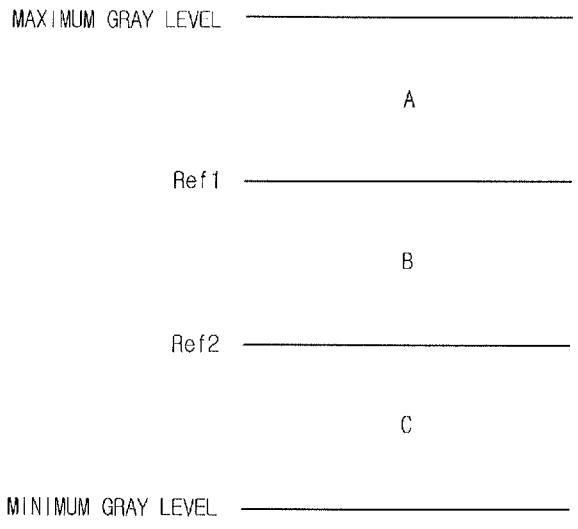
FIG. 10 is a data sheet illustrating polarities which are determined through the comparison of a data signal with first and second reference data according to a second embodiment of the disclosure.

FIG. 10 is a data sheet illustrating polarities which are determined through the comparison of a data signal with a first reference data and a second reference data according to a second embodiment of the disclosure.

As shown in FIG. 10, the data signal RGB can have any one from a minimum gray level to a maximum gray level.

The data signal RGB can be defined on the basis of the first reference data Ref1 and the second reference data Ref2 into an A polarity between the first reference data Ref1 and the maximum gray level, a B polarity between the first reference data Ref1 and the second reference data Ref2, a C polarity between the second reference data Ref2 and minimum gray level. The first reference data Ref1 and the second reference data Ref2 can be set to be any two between the maximum and minimum gray levels. The first reference data Ref1 can be set to be a higher gray level compared to the second reference data Ref2. The first reference data Ref1 is a data signal corresponding to the first charging voltage Vpre1, and the second reference data is another data signal corresponding to the second charging voltage Vpre2.

The data comparator 271 determines the polarity of the data signal RGB and applies the determined polarity of the data signal to the determiner 273 and the storage portion 275.

The storage portion 275 temporarily stores the polarities of the data signals of a previous period. In other words, the storage portion 275 temporarily stores the polarities of the data signals during a single period and then applies the polarities of the data signals of the previous period to the determiner 273.

The determiner 273 compares the polarity of the previous data signal applied from the storage portion 275 with the polarity of the current data signal applied from the data comparator 271 and determines whether or not it is necessary to perform the pre-charging and the charge-sharing.

if the polarity of the previous data signal is the same as that of the current data signal, the determiner 273 determines that it is unnecessary to perform the pre-charging and the charge-sharing. On the contrary, when the polarity of the previous data signal is different from that of the current data signal, the determiner 273 determines that it is necessary to perform the pre-charging and the charge-sharing. Also, if the polarity difference between the previous data signal and the current data signal corresponds to a single step, the pre-charging and the charge-sharing can be performed using a charging voltage opposite to the reference data which distinguishes the compared two polarities. Moreover, when the polarity difference between the previous data signal and the current data signal corresponds to double steps, the pre-charging and the charge-sharing can be performed using a charging voltage opposite to the reference data which is adjacent to the polarity of the current data signal.

For example, if the previous data signal has the A polarity and the current data signal has the B polarity, the determiner 273 determines that it is necessary to perform the pre-charging and the charge-sharing using the first charging voltage Vpre1 opposite to the first reference data Ref1.

Also, when the previous data signal has the C polarity and the current data signal has the B polarity, the determiner 273 determines that it is necessary to perform the pre-charging and the charge-sharing using the second charging voltage Vpre2 opposite to the second reference data Ref2.

Moreover, if the previous data signal has the A polarity and the current data signal has the C polarity, the determiner 273 determines that it is necessary to perform the pre-charging and the charge-sharing using the second charging voltage Vpre2 opposite to the second reference data Ref2 which is adjacent to the C polarity of the current data signal.

Furthermore, when the previous data signal has the C polarity and the current data signal has the A polarity, the determiner 273 determines that it is necessary to perform the pre-charging and the charge-sharing using the first charging voltage Vpre1 opposite to the first reference data Ref1 which is adjacent to the A polarity of the current data signal.

In this manner, the charging voltage opposite to the reference data, which is adjacent to polarity of the current data signal, is used to perform the pre-charging and the charge-sharing. As such, the charging capacitor can charge more electric charges when the data voltage falls, i.e., during the charge-sharing. Also, the charging capacitor can discharge more electric charges toward the data lines when the data voltage rises, i.e., during the pre-charging. Therefore, power consumption can be reduced.

The determiner 273 supplies the output portion 277 with the determination signal about whether or not to perform the pre-charging and the charge-sharing.

The output portion 277 generates an enable signal EN, which is used to control the pre-charging and the charge-sharing, on the basis of the determination signal applied from the determiner 273. The enable signal EN can be configured with two bits. The two bits of the enable signal EN can be used to control the pre-charging and the charge-sharing using one of the first charging voltage Vpre1 and the second charging voltage Vpre2 and using the other one.

The operation of the OLED device according to the second embodiment will be described using the data voltage on the first data line DL1 as an example and referring to FIGS. 8 through 10. If the previous data signal has the C polarity and the current data signal has the A polarity, the charging controller 270 applies an enable signal EN, which forces the pre-charging and the charge-sharing to be performed on the basis of the first charging voltage Vpre1, to the second latch 281. Then, the second latch 281 applies a first primary latch signal X1 to the logical comparator 283. As such, the logical comparator 283 outputs the first primary logical signal Y1 with the high level during the high level interval of the charging control signal Pre. The first primary logical signal Y1 forces the first primary charging switch 257 to be closed. In accordance therewith, the first data line DL1 is pre-charged with the first charging voltage Vpre1. At this time, electric charges stored in the first charging capacitor 263 are discharged to the first data line DL1. As a result, power consumption can be reduced.

Meanwhile, when the previous data signal has the A polarity and the current data signal has the C polarity, the charging controller 270 applies an enable signal EN, which forces the pre-charging and the charge-sharing to be performed on the basis of the second charging voltage Vpre2, to the second latch 281. Then, the second latch 281 applies a first secondary latch signal U1 to the logical comparator 283. As such, the logical comparator 283 outputs the first secondary logical signal Z1 with the high level during the high level interval of the charging control signal Pre. The first secondary logical signal Z1 forces the first secondary charging switch 259 to be closed. In accordance therewith, the first data line DL1 is charge-shared with the second charging voltage Vpre2. At this time, electric charges on the first data line DL1 are charged into the second charging capacitor 267. The electric charges stored in the second charging capacitor 250 can be used in the pre-charging, later. Therefore, power consumption can be reduced.

The plurality of primary charging switches 257 can be individually controlled by the respective primary logical signals Y1~Y4. Also, the plurality of secondary charging switches 259 can be individually controlled by the respective secondary logical signals Z1~Z4.

Although it is explained that the polarity of the data signal is defined into two or three through the first and second embodiments, the number of defined polarities is not limited to this.

Figure 11:
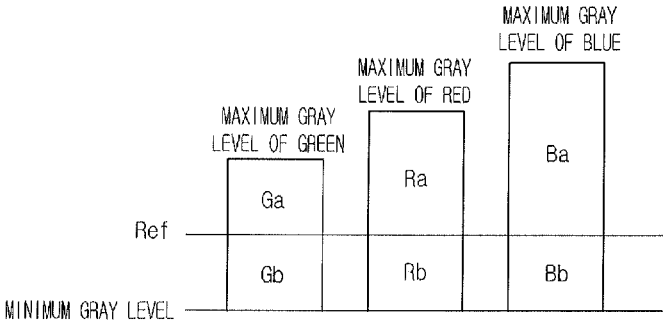
FIG. 11 is a data sheet illustrating polarities which are determined through the comparison of a data signal with a reference data according to a third embodiment of the disclosure.

FIG. 11 is a data sheet illustrating polarities which are determined through the comparison of a data signal with a reference data according to a third embodiment of the disclosure.

An OLED device of the third embodiment is the same as that of the first embodiment except that red, green and blue data signals are each defined into polarities with different areas on the basis of a single reference data opposite to a charging voltage Vpre. Accordingly, the description of the first embodiment to be repeated in the third embodiment of the present disclosure will be omitted.

Referring to FIG. 11, driving voltages used to drive red, green and blue sub-pixels within the OLED device are different from one another due to material properties of each color sub-pixel. Due to the driving voltage differences between the red, green and blue sub-pixels, polarities of red, green and blue data signals, which are defined by a reference data opposite to the same charging voltage Vpre, must have different gray level ranges (i.e., different areas) from one another.

The green data signal can be defined into a Ga polarity between the reference data Ref and a maximum gray level and a Gb polarity between the reference data Ref and a minimum gray level. The red data signal can be defined into a Ra polarity between the reference data Ref and the maximum gray level and a Rb polarity between the reference data Ref and the minimum gray level. The blue data signal can be defined into a Ba polarity between the reference data Ref and the maximum gray level and a Bb polarity between the reference data Ref and the minimum gray level.

The reference data Ref is set to be a gray level opposite to the same charging voltage Vpre. As such, the reference data Ref is applied to all the red, green and blue data signals in the same gray level. Therefore, the Gb, Rb and Bb polarities have the same area, but the Ga, Rb and Bb polarities must have different areas from one another due to the differences between maximum driving voltages in the OLED device.

In this way, since the polarities of the red, green and blue data signals are defined on the basis of a single reference data, the pre-charging and the charge-sharing can be performed using only a single charging line. Therefore, the circuit configuration of a data driver can be simplified and furthermore power consumption can be reduced.

Figure 12:
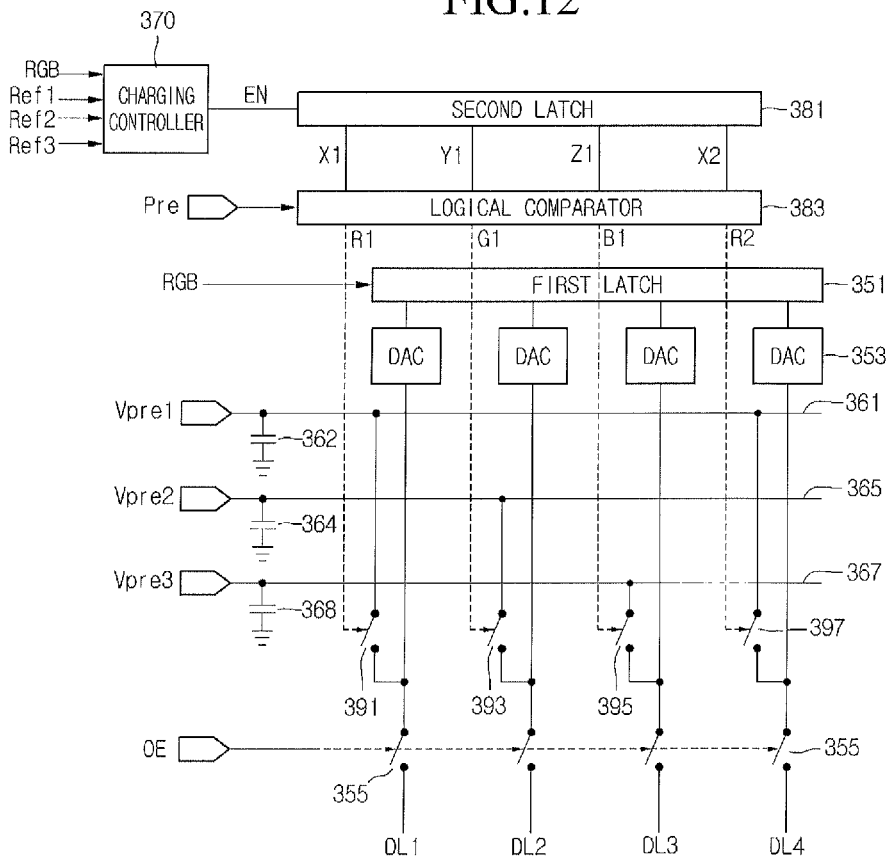
FIG. 12 is a circuit diagram showing a data driver of an OLED device according to a fourth embodiment of the present disclosure.

FIG. 12 is a circuit diagram showing a data driver of an OLED device according to a third embodiment of the present disclosure.

The fourth embodiment is the same as the first embodiment except that the polarity of the data signal is differently distinguished according colors including red, green and blue and the pre-charging and the charge-sharing are performed using a plurality of charging switches. Accordingly, the description of the first embodiment to be repeated in the fourth embodiment of the present disclosure will be omitted.

Referring to FIG. 12, the data driver of the OLED device according to a fourth embodiment of the present disclosure includes a first latch 351 and a plurality of DACs 353 connected to the first latch 351.

The first latch 351 sequentially latches data signals RGB applied from the timing controller (not shown). Also, the first latch 351 simultaneously outputs the latched data signals for a single horizontal line in response to a source output enable signal from the timing controller. The plurality of DACs 353 convert a single horizontal line of data signals applied from the first latch 351 into analog data voltages. The analog data voltages are simultaneously output from the DACs 353 to the plurality of data lines DL.

The plurality of data lines DL can include first through fourth data lines DL1~DL4. The first and fourth data lines DL1 and DL4 can be used to transmit data voltages to red pixels. The second data line DL2 can be used to transmit a green data voltage to a green pixel. The third data line DL3 can be used to transmit a blue data voltage to a blue pixel.

The data driver can further include first through third charging lines 361, 365 and 367 each extending in a direction crossing the data lines DL. The first through third charging lines 361, 365 and 367 can be formed parallel to one another.

A first charging voltage Vpre1 can be applied to one end of the first charging line 361. A first charging capacitor 363 can be connected to the first charging line 361. At the pre-charging and the charge-sharing, electric charges can be charged and discharged by means of the first charging capacitor 363. Therefore, power consumption can be reduced by an amount of electric charge being charged and discharged.

Also, a second charging voltage Vpre2 can be applied to one end of the second charging line 365. A second charging capacitor 364 can be connected to the second charging line 365. The second charging capacitor 364 can charge and discharge electric charges at the pre-charging and the charge-sharing. As such, power consumption can be reduced by an amount of electric charge being charged and discharged.

Moreover, a third charging voltage Vpre3 can be applied to one end of the third charging line 367. A third charging capacitor 368 can be connected to the third charging line 367. At the pre-charging and the charge-sharing, electric charges can be charged and discharged by means of the third charging capacitor 368. Therefore, power consumption can be reduced by an amount of electric charge being charged and discharged.

The first through third charging lines 361, 365 and 367 can be connected to the plurality of data lines DL through a plurality of charging switches. The plurality of charging switches can be individually controlled by a plurality of logical signals R1, R2, G1 and B1.

The first charging line 361 can be connected to the first data line DL1 through a first charging switch 391. The first charging switch 391 can be controlled by the first logical signal R1. The first charging line 361 can also be connected to the fourth data line DL4 through a fourth charging switch 397. The fourth charging switch 397 can be controlled by a fourth logical signal R2. The second charging line 365 can be connected to the second data line DL2 through a second charging switch 393. The second charging switch 393 can be controlled by the second logical signal G1. The third charging line 367 can be connected to the third data line DL3 through a third charging switch 395. The third charging switch 395 can be controlled by the third logical signal B1.

The switches 391, 391, 395 and 397 are not limited to those shown in the drawings. In other words, The first charging line 361 can be connected to a plurality of data lines corresponding to the number of red pixels, the second charging line 365 can be connected to a plurality of data lines corresponding to the number of green pixels, and the third charging line 367 can be connected to a plurality of data lines corresponding to the number of blue pixels The plurality of logical signals R1, R2, G1 and B1 can be generated by a charging controller 370, a second latch 381 and a logical comparator 383.

The charging controller 370 can receive a first reference data Ref1, a second reference data Ref2, a third reference data Ref3 and the data signals and sequentially output enable signals EN. The charging controller 370 compares the data signal RGB with the first reference data Ref1, the second reference data Ref2 and the third reference data Ref3 and determines whether or not it is necessary to perform a pre-charging and a charge-sharing. The charging controller 370 generates the enable signal EN in accordance with the determined resultant and applies the enable signal EN to the second latch 381. Such a charging controller 370 will be explained in detail referring to FIG. 13, later.

The second latch 381 can sequentially latch the enable signals EN applied from the charging controller 370 and simultaneously output a single horizontal line of latch signals R1, R2, G1 and B1.

The latch signals R1, R2, G1 and B1 being output from the second latch 381 are applied to the logical comparator 383. In addition, a charging control signal Pre can be applied to the logical comparator 383. When the charging control signal Pre has a high level, the logical comparator 383 can output the logical signals R1, R2, G1 and B1.

Figure 13:
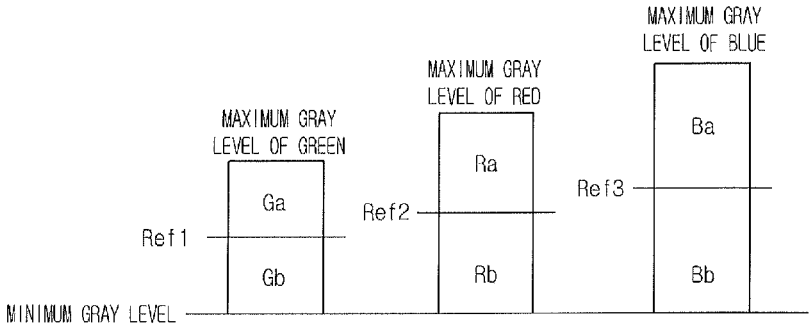
FIG. 13 is a data sheet illustrating polarities which are determined through the comparison of a data signal with a reference data according to a fourth embodiment of the disclosure.

FIG. 13 is a data sheet illustrating polarities which are determined through the comparison of a data signal with a reference data according to a fourth embodiment of the disclosure.

In the OLED device according the fourth embodiment, the polarity of a green data signal is determined on the basis of a first reference data Ref1 opposite to the first charging voltage Vpre1. The polarity of a red data signal determines is determined on the basis of a second reference data Ref2 opposite to the second charging voltage Vpre2. The polarity of the blue data signal is determined on the basis of a third reference data Ref3 opposite to the third charging voltage Vpre3.

The green data signal can be defined into a Ga polarity between the first reference data Ref1 and a maximum gray level and a Gb polarity between the first reference data Ref1 and a minimum gray level. The red data signal can be defined into a Ra polarity between the second reference data Ref2 and the maximum gray level and a Rb polarity between the second reference data Ref2 and the minimum gray level. The blue data signal can be defined into a Ba polarity between the third reference data Ref3 and the maximum gray level and a Bb polarity between the third reference data Ref3 and a minimum gray level.

As such, the area of the Ga polarity is the same as that of the Gb polarity. The area of the Ra polarity is the same as that of the Rb polarity. The area of the Ba polarity is the same as that of the Bb polarity.

Although it is not shown in the drawings, the polarity of a white data signal can be determined on the basis of a different reference data. In other words, if each pixel within the OLED device is configured with n sub-pixels for displaying different colors from one another, the polarities of color data signals can be determined using a plurality of reference data below n and then the pre-charging and the charge-sharing can be performed in each color data signal.

In this manner, the reference voltages can be set according to the colors. As such, the pre-charging and the charge-sharing can be efficiently performed even though a driving voltage difference between different color sub-pixels is generated due to material properties.

As described above, the OLED devices according to the embodiments allow the pre-charging and the charge-sharing to be performed in each data line. Therefore, power consumption and heat generation can be reduced.

The driving methods of the OLED device according to the embodiments enable not only the polarities of the data signal to be defined on the basis of an arbitrary reference data but also the pre-charging and the charge-sharing to be performed for a region in which the polarity variation exists. In accordance therewith, power consumption and heat generation can be reduced.

It should be understood that numerous other modifications and embodiments can be devised by those skilled in the art that will fall within the spirit and scope of the principles of this disclosure. In other words, although embodiments have been described with reference to a number of illustrative embodiments thereof, this disclosure is not limited to those. Accordingly, the scope of the present disclosure shall be determined only by the appended claims and their equivalents. In addition, variations and modifications in the component parts and/or arrangements, alternative uses must be regarded as included in the appended claims.

The invention claimed is:

1. A method of an organic light emitting display device, the method comprising:

detecting a polarity of a data signal for a pixel by comparing the data signal for a same pixel with a reference data;

temporarily storing the detected polarity of the data signal;

determining whether or not to perform a pre-charging and a charge-sharing through a comparison of the detected polarity of an Nth period and the detected polarity of an N-1th period for the same pixel;

outputting a charging operation control signal generated on a basis of the comparison; and performing the pre-charging and the charge-sharing in a data line on the basis of the charging operation control signal, wherein the determination for the performance of the pre-charging and the charge-sharing enables the pre-charging and the charge-sharing to be performed only when the detected and stored polarities for the same pixel are different from each other.

2. The method of claim 1, wherein the reference data is set to be a gray level which is used as a basis of the pre-charging and the charge-sharing.

3. The method of claim 1, wherein the polarity detection compares at least four high bits for the reference data and the data signal.

4. The method of claim 1, wherein the reference date includes first and second reference data, and wherein the polarity detection allows at least three step polarities to be selectively detected on the basis of first and second reference data.

5. The method of claim 4, wherein the pre-charging and the charge-sharing are performed using a charging voltage opposite to a reference data, which is adjacent to the detected polarity, when a difference between the detected polarity and the stored polarity corresponds to two steps.

6. The method of claim 1, wherein the reference data includes first through fourth reference data for red, green, blue and white data signals wherein the first through fourth reference data are set to be different gray levels.

7. The method of claim 1, wherein the reference data includes different reference data less than n when a pixel is configured with n sub-pixels.

8. The apparatus of claim 1, further comprising a plurality of data lines and a pre-charging and charge sharing line orthogonal to the plurality of data lines, wherein the pre-charging and charge sharing line is selectively connected to data lines of the plurality of data lines in accordance with the charging control signal for each of the data lines.

9. An apparatus comprising:

a detector to detect a polarity of a data signal for a pixel by comparing said data signal for a same pixel with a reference data;

a comparator to compare the detected polarity and a previously stored polarity of said data signal for the same pixel;

a determiner that determines a pre-charge voltage based on the reference data, the detected polarity, and a comparison between the detected polarity and the previously stored polarity of the data signal for the same pixel; and a controller to selectively perform pre-charging and charge-sharing based on the compared polarity and the determined pre-charge voltage, wherein said pre-charging and charge-sharing are performed for the same pixel only when said detected and stored polarities are different from each other.

10. The apparatus of claim 9, wherein said pre-charging and charge-sharing are performed with respect to one or more data lines.

11. The apparatus of claim 10, further comprising:

a charging line, arranged in a direction crossing said data lines, connected to a charging voltage supplier which supplies a charging voltage to a charging capacitor; and a plurality of charging switches connected between said charging line and said data lines, each selectively connecting to respective data lines according to a charging operation control signal from said controller.

12. The apparatus of claim 11, wherein said detector, said comparator and said controller are implemented with respect to a data driver.

* * * * *